US009653773B2

(12) United States Patent
Ferrari et al.

(10) Patent No.: US 9,653,773 B2
(45) Date of Patent: May 16, 2017

(54) SLOW WAVE RF PROPAGATION LINE INCLUDING A NETWORK OF NANOWIRES

(71) Applicants: Universite Joseph Fourier, Grenoble (FR); Institut Polytechnique de Grenoble, Grenoble (FR); Universidade de Sao Paulo—USP, Sao Paulo (BR)

(72) Inventors: Philippe Ferrari, Sonnaz (FR); Gustavo Pamplona Rehder, Sao Paulo (BR); Ariana Serrano, Sao Paulo (BR); Florence Podevin, Grenoble (FR); Anne-Laure Franc, Grenoble (FR)

(73) Assignees: UNIVERSITE GRENOBLE ALPES, Grenoble (FR); INSTITUTE POLYTECHNIQUE DE GRENOBLE, Grenoble (FR); UNIVERSIDADE DE SAO PAULO USP, Sao Paulo (BR)

( * ) Notice: Subject to any disclaimer, the term of this patent is extended or adjusted under 35 U.S.C. 154(b) by 0 days.

(21) Appl. No.: 14/395,176

(22) PCT Filed: Apr. 24, 2013

(86) PCT No.: PCT/FR2013/050908

§ 371 (c)(1),
(2) Date: Oct. 17, 2014

(87) PCT Pub. No.: WO2013/160614

PCT Pub. Date: Oct. 31, 2013

(65) Prior Publication Data

US 2015/0070110 A1 Mar. 12, 2015

(30) Foreign Application Priority Data

Apr. 24, 2012 (FR) ..... 12 53759

(51) Int. Cl.
*H01P 9/00* (2006.01)
*H01P 3/00* (2006.01)
*H01P 3/08* (2006.01)

(52) U.S. Cl.
CPC ..... *H01P 9/00* (2013.01); *H01P 3/00* (2013.01); *H01P 3/003* (2013.01); *H01P 3/082* (2013.01)

(58) Field of Classification Search
CPC ..... H01P 3/081; H01P 3/082; H01P 9/00
(Continued)

(56) References Cited

U.S. PATENT DOCUMENTS 7,297,423 B2 * 11/2007 Mizuno ..... H01P 3/081 428/329
2007/0188275 A1 8/2007 Wakakayashi

FOREIGN PATENT DOCUMENTS

EP 1376745 A1 1/2004
WO 2010003808 A2 1/2010

OTHER PUBLICATIONS

Written Opinion of the International Searching Authority issued in PCT/FR2013/050908 issued on Oct. 28, 2014.
(Continued)

*Primary Examiner* — Benny Lee
(74) *Attorney, Agent, or Firm* — Moreno IP Law LLC

(57) ABSTRACT

The instant disclosure describes a radiofrequency propagation line including a conducting strip connected to a conducting plane parallel to the plane of the conducting strip, wherein the conducting plane includes a network of nanowires made of an electrically conductive, non-magnetic material extending orthogonally to the plane of the conducting strip, in the direction of said conducting strip.

6 Claims, 2 Drawing Sheets

(58) Field of Classification Search
USPC ..... 333/238, 161
See application file for complete search history.

(56) References Cited

OTHER PUBLICATIONS

A. L. Franc, et al., "Metallic Nanowire Filled Membrane for Slow Wave Microstrip Transmission Lines", Semiconductor Conference Dresden-Grenoble (ISCDG), 2012 International, IEEE, Sep. 24, 2012, pp. 191-194 XP032271718.
Martin Coulombe et al. "Substrate Integrated Artificial Dielectric (SIAD) Structure for Miniaturized Microstrip Circuits", IEEE Antennas and Wireless Propagation Letters, IEEE, Piscataway, NJ US, vol. 6, Jan. 1, 2007 pp. 575-579, XP011196280.
William Whittow, et al., "Microwave Aperture Antennas Using Nanomaterials", Antennas and Propagation (EUCAP), 2010, Proceedings of the Fourth European Conference on, IEEE, Piscataway, NJ US, Apr. 12, 2010, pp. 1-4, XP031705828.
Aggarwal, A.O., et al.: "New Pradigm in IC-Package Interconnections by Reworkable Nano-Interconnects", Electronic Components and Technology, 2004, ECTC '04, Proceedings Las Vegas, NV US, Jun. 1-4, 2004, Piscataway, NJ, IEEE, vol. 1, Jun. 1, 2004, pp. 451-460, XP010714711.
International Search Report issued in PCT/FR2013/050908 on Jul. 24, 2013.

* cited by examiner

- PRIOR ART -

- PRIOR ART -

- PRIOR ART -

SLOW WAVE RF PROPAGATION LINE INCLUDING A NETWORK OF NANOWIRES

BACKGROUND

The present disclosure relates to a radiofrequency (RF) propagation line. "Radiofrequency" here means the field of millimetric or submillimetric waves, in a frequency range from 10 to 500 GHz.

DISCUSSION OF THE RELATED ART

The continuous development of integrated circuits appears to be adapted to operations at very high frequency in the radiofrequency range. The passive elements used comprise adapters, attenuators, power dividers, filters, antennas, phase-shifters, baluns, etc. The propagation lines connecting these elements form a base element in an RF circuit. To achieve this, propagation lines having a high quality factor are necessary. The quality factor is an essential parameter since it represents the insertion losses of a propagation line for a given phase shift.

Generally, such propagation lines comprise a conductive strip having lateral dimensions ranging from less than 10 to approximately 50 μm and a thickness on the order of one micrometer (from 0.5 to 3 μm according to the technology used). Such a conductive strip is surrounded by one or a plurality of upper and/or lower lateral conductors forming ground planes intended to form, with the conductive strip, a waveguide-type structure. In technologies compatible with the forming of electronic integrated circuits (on silicon, for example), the conductive strip and the ground planes are formed of elements of metallization levels formed above a semiconductor substrate.

The simplest high-frequency propagation line is that illustrated in FIG. 1. This line comprises a conductive microstrip 1 having a surface area per length unit S arranged above a thin insulating layer 3, itself formed above a conductive ground plane 5 supported by a substrate 7.

It is known that, to increase the quality factor of such a line and to decrease its physical length while keeping a same electric phase shift, it is desirable to decrease the wave propagation speed in this line. Such a propagation speed is proportional to the inverse of the square root of the product of the inductance per length unit L by the capacitance per length unit C of the line. The capacitance per length unit of the line may be approximated to $\in S/h$, with $\in$ designating the dielectric permittivity of the insulating material of layer 3 and h designating the thickness of layer 3. Dielectric permittivity $\in$ thus cannot be very significantly varied. Indeed, such a dielectric permittivity depends on the material forming insulating layer 3 and the materials of high permittivity are often materials difficult to deposit and little compatible with embodiments in the context of integrated circuits. It can thus be attempted to increase the surface area per length unit S of the line or to decrease thickness h of the insulator. Unfortunately, such solutions, if they effectively tend to increase capacitance C, correlatively tend to decrease inductance L. Product C.L then remains substantially constant. Other ways to obtain miniaturized propagation lines having a high quality factor have thus been searched for.

A particularly high-performance type of propagation line is described in U.S. Pat. No. 6,950,590, having FIG. 4a thereof copied in appended FIG. 2. On a silicon substrate 128 coated with metal levels separated by an insulator 127 is formed a lower conductive plane 136 divided into parallel strips of small width, for example, approximately ranging from 0.1 to 3 μm. In a higher metallization level is formed a central conductive strip 122 forming the actual propagation line, surrounded with lateral coplanar ground strips 124, 126.

Features and advantages of such a line are described in detail in the above-mentioned US patent. The assembly of central strip 122 and of ground lines 124 and 126 being coplanar, such a structure is currently called coplanar waveguide CPW. Further, as indicated in this patent, the structure forms a slow wave coplanar waveguide, currently called S-CPW. As a result, the line may have a smaller length than a conventional line for a same phase shift.

It is reminded at paragraph [0046] of U.S. Pat. No. 6,950,590 that "The S-CPW transmission line configuration shields the electric field and allows the magnetic field to fill a larger volume, in effect increasing the energy stored by the transmission line. This causes a dramatic increase in Q-factor".

Even though the transmission line of U.S. Pat. No. 6,950,590 has many advantages as concerns its small losses, it has the disadvantage of occupying a relatively large surface area due to the need to provide two ground planes on either side of the propagation strip. At 60 GHz, the width of the line including the two lateral conductive planes should be in the range from 50 to 125 μm, the highest value corresponding to the highest quality factor. Further, usage frequencies are limited to values in the range from 60 to 100 GHz. Indeed, the width of the parallel strips forming the division of lower conductive plane 136 cannot in practice be decreased to values smaller than 0.2 μm, unless very advanced and expensive technologies are used and, accordingly, as the frequency increases, eddy currents start circulating in these strips, which causes losses which may be significant.

M. Colombe et al.'s article, published in IEEE Antennas and Wireless Propagation Letters, Vol. 6, 2007, describes a dielectric structure for microstrip circuits such as illustrated in FIG. 3. This structure comprises a line 21 formed on a first surface of a first insulating substrate 22 having a first thickness h1 and having its second surface supported by the first surface of a second insulating substrate 23 (having a second thickness h2) crossed by conductive vias 24. On the second surface of second insulating substrate 23 is formed a conductive substrate 25, in electric contact with vias 24. Substrates 22 and 24 are indicated as being made of the "RT/DUROID" 6002 microwave laminate and as having same thicknesses (0.508 mm), i.e., h1=h2. This article targets devices operating at frequencies from 1 to 5 GHz. The article indicates that the structure allows a "wavelength compression", which corresponds to a decrease of the phase speed of the wave causing a decrease of the surface area per length unit. Such a decrease however appears as insufficient and the structure is not adapted to frequencies greater than 10 GHz.

A propagation line having a high performance in terms of quality factor and occupying a minimum surface area per length unit is thus needed.

A propagation line having a high performance in terms of quality factor and capable of operating at frequencies greater than 100 GHz, for example, up to 500 GHz, is also needed.

SUMMARY OF THE INVENTION

Thus, an embodiment of the present invention aims at forming a microstrip line which is a propagation line having a minimum surface area per length unit, having low losses and capable of operating at frequencies which may reach a value in the order of 500 GHz.

More generally, an embodiment of the present invention aims at providing a support for a system operating at high frequency wherein the electric field associated with the line concentrates on a minimum thickness while the magnetic field may have a much wider extension.

An embodiment of the present invention provides a radiofrequency propagation line comprising a conductive strip formed on a first insulating layer having a first thickness, h1, associated with a conductive plane parallel to the plane of said strip, wherein the conductive plane comprises a network of nanowires made of an electrically-conductive and non-magnetic material extending in a second insulating layer having a second thickness, h2, all the way to the first insulating layer, orthogonally to the plane of the conductive strip, towards said strip, ratio h1/h2 between the thicknesses of the first and second insulating layers being smaller than 0.05.

According to an embodiment of the present invention, the nanowires are formed in a ceramic layer formed on a conductive plane, the ceramic layer being itself coated with an insulating layer.

According to an embodiment of the present invention, the ceramic layer is an alumina layer.

According to an embodiment of the present invention, the first insulating layer has a thickness in the range from 0.5 to 2 μm and the nanowires have a length from 50 μm to 1 mm.

According to an embodiment of the present invention, the nanowires have a diameter from 30 to 200 nm and a spacing from 60 to 450 nm.

An embodiment of the present invention provides a radiofrequency component support comprising, under a first insulating layer, a second insulating layer crossed by nanowires connected to a conductive plane, ratio h1/h2 between the first and second insulating layers being smaller than 0.05.

BRIEF DESCRIPTION OF THE DRAWINGS

The foregoing and other features and advantages will be discussed in detail in the following non-limiting description of specific embodiments in connection with the accompanying drawings, among which.

It should be noted that generally, as usual in the representation of microelectronic components, the elements of the various drawings are not drawn to scale.

DETAILED DESCRIPTION OF THE INVENTION

Figure 1:
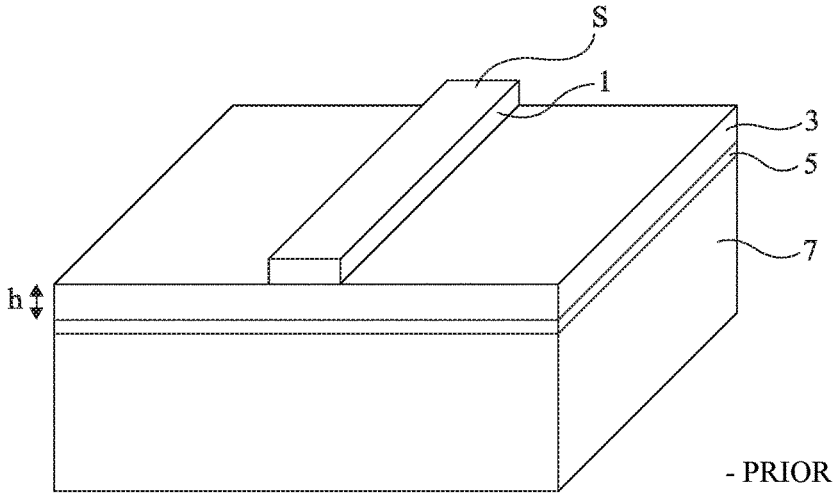
FIG. 1, previously described, is a perspective view illustrating a prior art microstrip-type propagation line.
Figure 2:
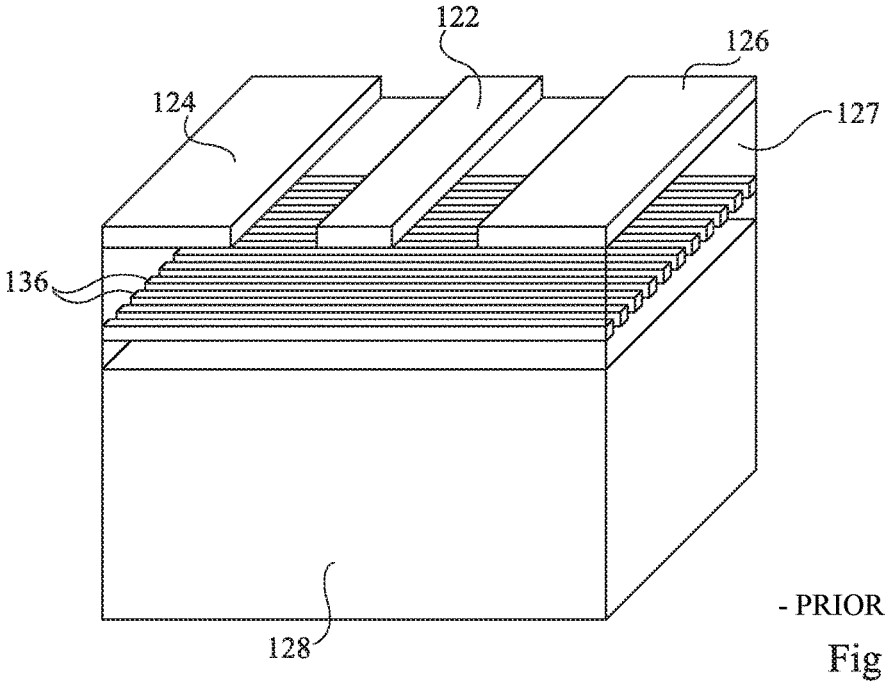
FIG. 2, previously described, is a copy of FIG. 4*a* of U.S. Pat. No. 6,950,590.
Figure 3:
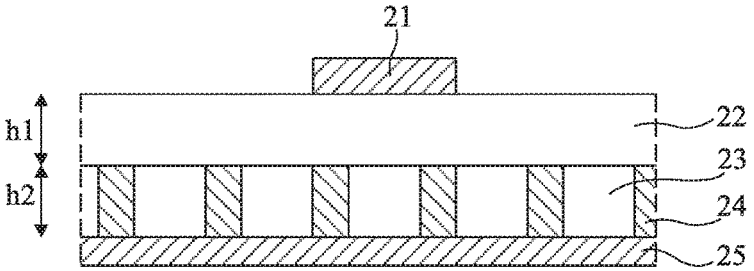
FIG. 3, previously described, illustrates the structure described in M. Colombe et al.'s above-mentioned article.
Figure 4:
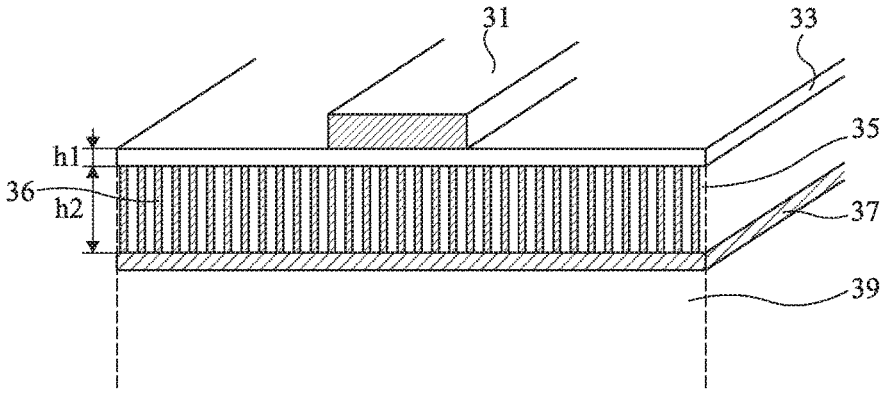
FIG. 4 is a cross-section view of an embodiment of a slow wave microstrip-type line.

FIG. 4 shows an embodiment of a microstrip-type line. A conductive strip 31 is laid on a first insulating layer 33 having a thickness h1, formed on a second insulating layer 35 laid on a ground plane 37 which may be formed above a substrate 39. Insulating layer 33 may be a layer of silicon oxide or of another insulating material currently used in integrated circuit manufacturing. Layer 37 for example has a thickness from 0.5 to 2 μm. Second insulating layer 35 for example is a layer of a ceramic such as alumina. Layer 35 is provided with substantially vertical cavities (in a plane orthogonal to the plane of strip line 31). The cavities are filled with nanowires 36 made of a non-magnetic conductive material, for example, copper, aluminum, silver, or gold, in electric contact with ground plane 37. Various ways to manufacture a nanowire network in an alumina membrane of variable porosity are known and may be used. According to an advantage, nanowires 36 may have a small diameter, for example, from 30 to 200 nm with an edge-to-edge distance from 60 to 450 nm. Their length, which corresponds to thickness h2 of insulating layer 35, may be in the range from 50 μm to 1 mm, that is, if h1 is equal to 2.5 μm, ratio h1/h2 will be in the range from 0.0025 to 0.05.

Figure 5:
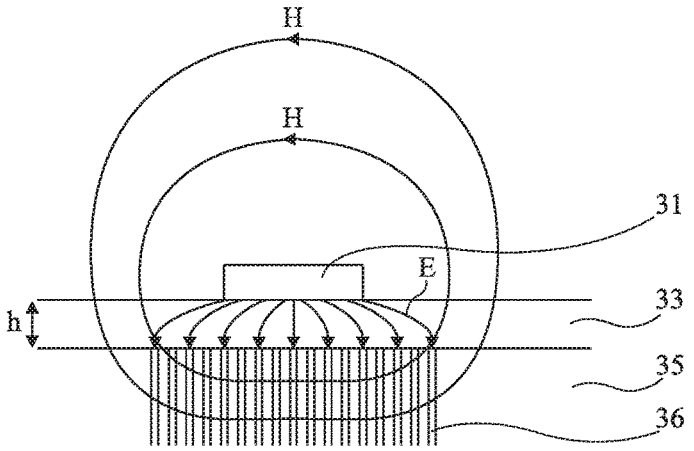
FIG. 5 shows an enlargement of a portion of FIG. 4.

FIG. 5 illustrates the shape of electric field lines E and of magnetic field lines H, when a signal is applied to line 31. For electric field E, the thickness of the insulating layer where this field spreads is limited to thickness h of layer 33, given that the ends of nanowires 36 in the interface plane between layers 33 and 35 correspond to an equipotential line at the same potential as conductive plane 37 (FIG. 4), currently the ground. Thus, the electric field does not vary below this interface between layers 33 and 35. However, from the point of view of magnetic field H, the field lines freely penetrate into second insulating material 35 without being disturbed by the nanowires, which are made of non-magnetic material.

This provides again the advantage of an increase of the quality factor of the transmission line mentioned in above-mentioned U.S. Pat. No. 6,950,590. This advantage is here obtained in a simple propagation line of the type having a micro strip and a ground plane, where the micro strip may have a width of a few μm only, for example, from 3 to 10 μm.

Figure 6:
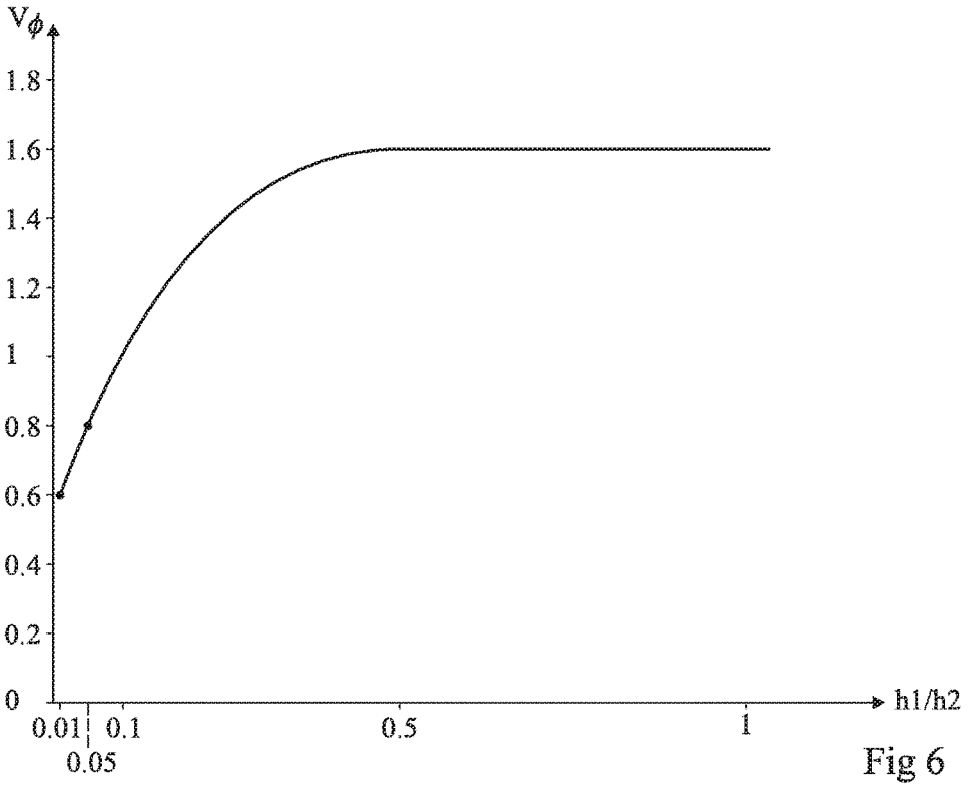
FIG. 6 is a curve illustrating the phase speed of a line according to physical characteristics of this line.

FIG. 6 shows the variation of phase speed $V_T$ according to ratio h1/h2. It should be noted that $V_\phi$ remains substantially constant as long as ratio h1/h2 is greater than 0.4 but rapidly decreases as soon as h1/h2 becomes smaller than 0.2. In particular, $V_\phi$ decreases by half as soon as h1/h2 becomes smaller than 0.05. It should be noted that such values of h1/h2, and thus of $V_\phi$, are not suggested in M. Colombe's above-mentioned article and could not be reached with the types of substrate which are described therein.

The diameter of the nanowires may be selected so that it is smaller than the skin depth of the semiconductor material forming the nanowires at the provided usage frequency. As an example, for copper, the skin depth at 60 GHz is in the order of 250 nm. It would be easy to form nanowires of smaller diameter. The smaller the diameter, the less eddy current will create in the nanowires and the smaller the losses due to the magnetic field.

The present invention is likely to have many alterations and modifications which will occur to those skilled in the art. More specifically, the present invention has been described in relation with a specific embodiment relating to a strip-type propagation line. It should be noted that generally, a radiofrequency component support comprising, under a first insulating layer, a second insulating layer crossed by nanowires connected to a conductive plane, is provided for any application where it is desired to have a material having a first insulating thickness in terms of electric field distribution and a second insulating thickness greater than the first one in terms of magnetic field distribution. The second insulating layer crossed by nanowires may be air.

In the described embodiment, the nanowires are vertical nanowires extending from a conductive plane. It should be noted that the nanowires are not necessarily strictly vertical but may extend along porosities of a layer of a selected material, for example, a ceramic, the important point being to have an electric continuity between the end of the nanowires in contact with the conductive plane and their end located at the upper level of insulating layer 35 (FIG. 4).

The invention claimed is:

1. A radiofrequency propagation line comprising a conductive strip formed on a first insulating layer having a first thickness, h1, associated with a conductive plane parallel to the plane of said strip, wherein the conductive plane comprises a network of nanowires made of an electrically-conductive and non-magnetic material extending through a second insulating layer having a second thickness, h2, so as to contact the first insulating layer, orthogonally to the plane of the conductive strip, towards said strip, a ratio h1/h2 between the thicknesses of the first and second insulating layers being smaller than 0.05.

2. The propagation line of claim 1, wherein the second insulating layer is a ceramic layer formed on a conductive plane, the ceramic layer being itself coated with the first insulating layer.

3. The propagation line of claim 2, wherein the ceramic layer is an alumina layer.

4. The propagation line of claim 1, wherein the first thickness, h1, of the first insulating layer is in the range from 0.5 to 2 μm and the network of nanowires have a length from 50 μm to 1 mm.

5. The propagation line of claim 1, wherein each nanowire in the network of nanowires has a diameter from 30 to 200 nm and a spacing between the nanowires from 60 to 450 nm.

6. A radiofrequency component support comprising, under a first insulating layer having a first thickness, h1, a second insulating layer having a second thickness, h2, the second insulating layer crossed by nanowires connected to a conductive plane, a ratio h1/h2 being smaller than 0.05.

* * * * *